United States Patent [19]

Vrijssen

[11] Patent Number: 4,853,589

[45] Date of Patent: Aug. 1, 1989

[54] ELECTRON BEAM DEVICE HAVING AN ELECTRON GUN AND A METHOD OF MAKING THE ELECTRON GUN

[75] Inventor: Gerardus A. H. M. Vrijssen, Eindhoven, Netherlands

[73] Assignee: U.S. Philips Corporation, New York, N.Y.

[21] Appl. No.: 168,849

[22] Filed: Mar. 16, 1988

[30] Foreign Application Priority Data

Mar. 25, 1987 [GB] United Kingdom ..... 8707169

[51] Int. Cl.[4] ..... H01J 9/28; H01J 29/90

[52] U.S. Cl. ..... 313/477 R; 65/110; 445/34; 313/450

[58] Field of Search ..... 445/34; 65/110; 313/450, 477 R, 477 HC, 291

[56] References Cited

U.S. PATENT DOCUMENTS

| | | | |
|---|---|---|---|
| 2,200,911 | 5/1940 | Bowie | 313/450 X |
| 3,040,205 | 6/1962 | Walker | 313/450 X |
| 3,375,390 | 3/1968 | Schlesinger | 313/450 |
| 4,213,557 | 7/1980 | Franzen | 65/110 X |
| 4,334,904 | 6/1982 | Apothaker et al. | 65/110 X |
| 4,713,879 | 12/1987 | Vrijssen | 445/36 |

*Primary Examiner*—Kenneth J. Ramsey

*Attorney, Agent, or Firm*—Robert J. Kraus

[57] ABSTRACT

An electron gun for an electron beam device comprises a vitreous elongate tubular body (22) having a plurality of electrodes (24, 27 to 31 and 33 to 37) provided therein. Electrical connections (50, 52, 54) to at least some of these electrodes comprise respective conductors extending within the thickness of the wall of the tubular body (22). The tubular body is made by uniting inner and outer cylindrical members under the influence of heat while drawing them under sub-atmospheric pressure onto a profiled mandril, the electrical connections (50, 52 and 54) having been prepositioned on the inner cylindrical member.

33 Claims, 5 Drawing Sheets

ELECTRON BEAM DEVICE HAVING AN ELECTRON GUN AND A METHOD OF MAKING THE ELECTRON GUN

BACKGROUND OF THE INVENTION

The present relates to an electron beam device comprising an evacuated envelope formed by an optically transparent faceplate, a conical portion and a neck, an electron gun within the evacuated envelope and to a method of making the electron gun. In the present specification an electron beam device is to be understood to include cathode ray tubes, X-ray tubes, electron beam lithography apparatus, scanning and transmission microscopes, electron guns for scanning Auger mass spectrometers and also ion guns (not an electron beam device within the normal meaning of the term). For convenience of description, the electron beam device will be described with reference to a cathode ray tube.

Unpublished European Patent Application No. 86200481.9 discloses a cathode ray tube in which the electron gun comprises an elongate tubular substrate which has been vacuum formed on a bipartite mandril, a beam forming part comprising a number of deep drawn metal electrodes respectively bearing against a succession of stepped abutments formed interiorly of th tubular substrate and a lens part formed by helical prefocusing and focusing electrodes in a resistive film applied to the internal surface of the tubular substrate. Some of the electrical connections to the metal electrodes and to at least one point in the resistive film are made through the wall of the tubular substrate. Each of these electrical connections comprises a conical hole sand blasted through the substrate wall, an indium ball in the conical hole, which ball is contacted by a lead-out wire and conventional crystallizing glass for fusing together the component parts. Any part of the wires and/or indium balls protruding into the tube are cut-off flush. Although this type of electrical connection has been found to be generally satisfactory it has a number of disadvantages, especially from a manufacturing point of view. The electrical connection is complicated, and thereby, is expensive to make. It is not possible to ensure a good electrical contact with an electrode due to the use of the indium balls. Further the lead-out wires which are unsupported have to be held in position while the crystallizing glass is being baked.

SUMMARY OF THE INVENTION

An object of the present invention is to improve the electrical connections to this type of electron gun.

According to one aspect of the present invention there is provided an electron beam device comprising an evacuated envelope formed by an optically transparent faceplate, a conical portion and a neck, an electron gun within the evacuated envelope formed by a tubular housing of an electrically insulating material, a plurality of electrodes carried by the housing and located at respective axially spaced positions therein, and an electrical connection to at least one of the electrodes, characterized in that said connection comprises a conductor extending within the wall of the tubular housing intermediate its inner and outer surfaces and has a terminal portion extending inwardly through the housing wall and makes an electrical contact with the at least one electrode.

By having an electrical connection constituted by a buried conductor, the conductor is protected thereby making the electron gun easier to handle. The terminal portion extending through the housing wall enables a quality check to be made before proceeding to the steps of providing the different electrodes which may be deep drawn metal components and/or one or more helices of a resistive material. The conductor may comprise an internal interconnection between a pair of electrodes of the electron gun but also may constitute a lead-out conductor having a portion extending from the end of the housing.

The coefficients of expansion of the conductors and the material of the tubular body, for example lead oxide glass, need not be matched because a vacuum-tight seal is not necessary. Of greater importance is the maintenance of adequate electrical insulation between the electrical connections and avoiding cracking of the tubular body when completing the manufacture of the electron gun.

A preferred embodiment of an electron beam device according to the invention is characterized in that the tubular housing forms a part of the envelope. When the tubular housing forms a part of the envelope less parts have to be used in the electron beam device. This makes the electron beam device according to the preferred embodiment of the invention more elegant. Furthermore, the cost-price of an electron beam device is decreased since less parts have to be used.

According to another aspect of the present invention there is provided a method of making an electron gun for an electron beam device, the electron gun comprising an electrically insulating tubular body having electrodes provided therein and electrical connections to said electrodes, the method comprising pre-positioning one or more conductors on the external surface of a first cylindrical member, a terminal portion of the or each conductor extending through an aperture or a respective aperture in the wall of the first member, providing a suction mandril interiorly of the first member, arranging a second cylindrical member about the first member, uniting the first and second members with the conductors therebetween by heating them and drawing them under sub-atmospheric pressure onto the suction mandril so that the first and second members unite inseparably to form a tubular body, removing the suction mandril from the formed tubular body and providing electrodes in said tubular body.

The suction mandril may be a one part mandril in which case the steps formed on the mandril may be of increasing or decreasing cross-section relative to that of the tubular portion. However the suction mandril may be a bipartite mandril which enables the cross-section of the tubular portion to be of any suitable size to minimize the lens aberrations.

The first and second members may consist of a vitreous material, for example lead oxide glass, which is suitable for further processing of the electron gun such as the application of the resistive film in which the helices are provided.

When inseparably uniting the first and second cylindrical members with the conductors therebetween it is important that the heating and cooling cycle is such as to minimise the residual stresses in the glass. In one embodiment the cylindrical members are heated to 620° C. while the inside of the second cylindrical member is under a sub-atmospheric pressure of $10^{-5}$ to $10^{-65}$ mm Hg. for at least 26 minutes, the mean rate of heating-up being 50° C. per minute. The sub-atmospheric pressure is maintained during the cooling phase. Ideally the cooling phase should be annealing under a controlled temperature reduction to room temperature. However acceptable results have been obtained by controlling the rate of cooling between 620° C. and say 380° C. and then letting the remainder of the cooling cycle be uncontrolled.

British Patent Specification No. 593.500 discloses fabricating thermionic valve bases by disposing glass covered pins in a die block, surrounding the pins with a shallow flanged member and inserting a second glass tubular member within the pins carried by the die block. The second member comprises a pump stem the end of which is located in a recess in the die block. By heating the glass components and sucking on the pump stem the glass components are drawn down on the die and form a seal around the pins.

British Patent Specification No. 369.349 discloses forming an annular pinch between glass envelope and an outwardly turned-back end of a glass exhaust tube, lead-out wires being disposed between the two glass components.

There is no disclosure or suggestion of manufacturing electron guns by forming a tubular body from two inseparably joined cylindrical members.

BRIEF DESCRIPTION OF THE DRAWING

The present invention will now be described, by way of example, with reference to the accompanying drawing figures, wherein.

In the drawing figures, corresponding reference numerals have been used to indicate the same parts.

DESCRIPTION OF THE PREFERRED EMBODIMENTS

Figure 1:
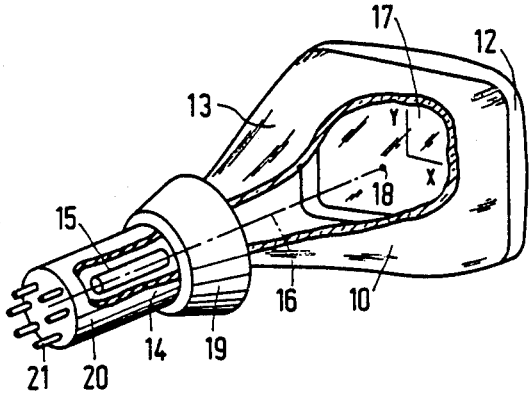
FIG. 1 is a perspective view of a monochrome display tube, for example a projection television tube, with a portion of the envelope wall broken away.

Referring initially to FIG. 1, the monochrome display tube comprises an evacuated envelope 10 formed by an optically transparent faceplate 12, a conical portion 13 and a neck 14. An electron beam 16 produced by the electron gun 15 forms a spot 18 on a cathodoluminescent screen 17 provided on the internal surface of the faceplate 12. A magnetic deflection yoke 19 scans the spot 18 in the X and Y directions across the screen 17. External connections to the electrodes of the electron gun 15 are by means of pins 21 in a glass end cap 20 fused to the neck 14.

Figure 2:
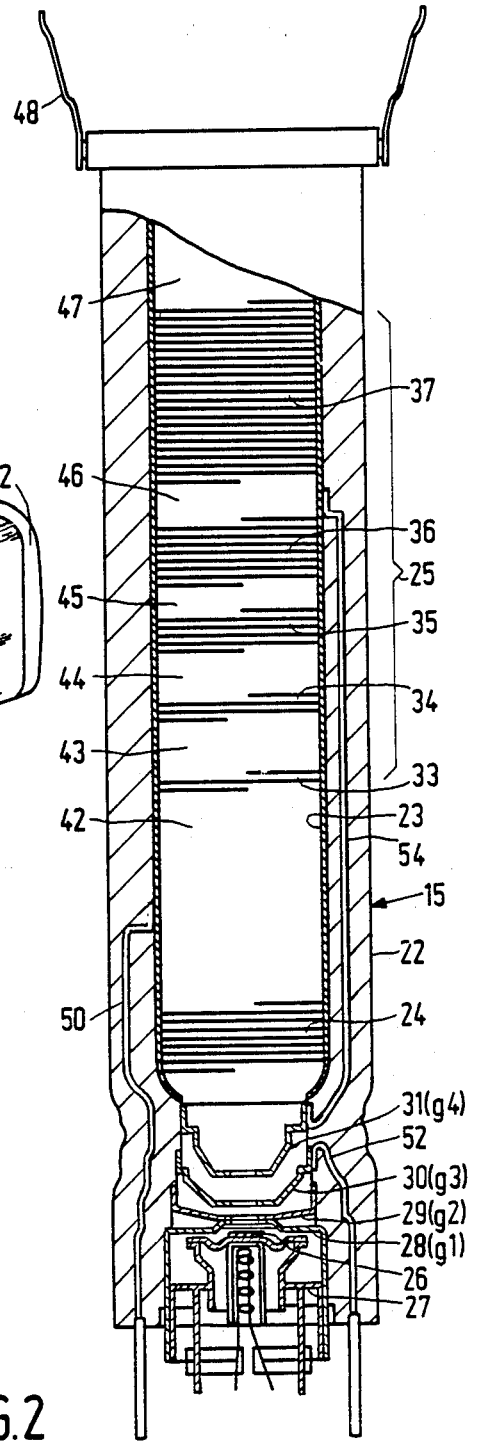
FIG. 2 is a diagrammatic longitudinal cross-sectional view through an electron gun used in the display tube shown in FIG. 1.

FIG. 2 shows the electron gun 15 in greater detail. The electron gun 15 comprises a tubular body 22 of an electrically insulating material, for example glass, which is made by softening two concentric lead glass cylindrical members and drawing them on a mandril to form an inseparable tubular body 22. An example of how this process is carried out will be described later with reference to FIGS. 4, 5 and 6. Adjacent one end of the tubular body 22 a series of annular steps of increasing diameter towards the open end of the tubular body 22 are provided and serve as engaging or abutment surfaces for electrodes 27 to 21 in the beam forming section of the electron gun. The remainder of the tubular body 22 has a homogeneous high ohmic resistive layer 23, for example a glass enamel with ruthenium oxide particles, thereon. A pre-focusing lens 24 is formed as a helix in the resistive layer 23 which also has a 5-segment helical bi-potential focusing lens 25 provided therein. The lens diameter is of the order of 10 mm. In an embodiment of a projection display tube the distance between the object formed by the cross-section in the beam forming part of the electron gun and the end of the last helical segment is 73 mm and the distance between the last segment and the screen 17 is 130 mm.

The beam forming part of the electron gun comprises an indirectly heated cathode 26 which is carried by, and electrically insulated from, a drawn, thin-walled sleeve 27 which is secured to an apertured, drawn thin-walled metal sleeve 28 which consitutes a grid $g_1$. Proceeding in the direction of the electron beam path from the cathode 26, there are successively arranged apertured grids $g_2$, $g_3$ and $g_4$ formed by drawn, thin-wall metal sleeves 29, 30 and 31.

The five helical segment focusing lens 25 is constituted by five helical segments 33 to 37 of constant pitch alternated with intermediate, plain cylindrical segments 42 to 47 of the high-ohmic resistance material 23. An electrical connection is made to the segment 42 via a lead-out wire 50 to which for example a focusing voltage $V_f$ of 3 kV is applied. The segment 47 is typically at a screen voltage $V_s$ of 30 kV which is derived by making an electrical contact, via a spring contact 48 mounted on the end of the tubular body 22 with a conductive layer (not shown) on the inside of the conical portion 13, the conductive layer being electrically connected to an anode button (not shown). An electrical connection is made to the metal sleeve 30, via a lead-out wire 52 which is angularly displaced about the longitudinal axis of the tubular body relative to the lead-out wire 50. The electrical connection to the metal sleeve 31 is derived by a wire 54 connected to the plain segment 46 which as a result of voltage division is at the required voltage for grid $g_4$. The wire 54 has the smallest permissable cross-section consistent with the anticipated current flow therethrough so that the field produced by the wire has negligible effect on the focusing lens fields.

In operation, when the mentioned voltages are applied across the helical segments of the lens, the helical segments function as a voltage divider and the intermediate segments 43, 44 45 and 46 each acquire a different fixed potential which is determined by the ratio of the lengths of the helical segments, assuming that all of the helices are of constant pitch. By optimizing the axis potential in the focusing lens, then a lens having a minimum spherical aberration for a particular magnification can be obtained. In the case of a bipotential focusing lens and constant pitch helices, it has been found that the desired optimization can be achieved by making the length of the helical segments 33 to 37 increase gradually from the object point, that is the cross-over in the beam forming part of the electron gun, and making the length of the intermediate segments 43 to 46 decrease gradually. The minimum length of a helical segment should be one turn. In deciding on the pitch and bandwidth of the turns of the helix regard has to be paid to achieving the required potential difference of each helical segment, the reproducibility of the segments and avoiding exposing too much of the substrate leading to the risk of charge build-up thereon. The choice of the band-width of the turns of the helices is influenced partly by the degree of smoothness of, or, alternatively, the irregularities in, the edges of the helical track. Since the helices may be formed by scratching a helical track through the resistive layer 23 or removal of the resistance material using a laser beam, the particulate size of the resistive material will have some effect on the coarseness of the edges. Consequently the width of the helical track is chosen so that the effects of any irregularities in the edges are negligible. The pitch is chosen so that the desired characteristics of electrical insulation between turns and avoidance of charge build-up are obtained. Due to the constant pitch and the homogeneous resistance, the potential along the segments increases or decreases linearly enabling an equal field strength to prevail along each segment.

Figure 3:
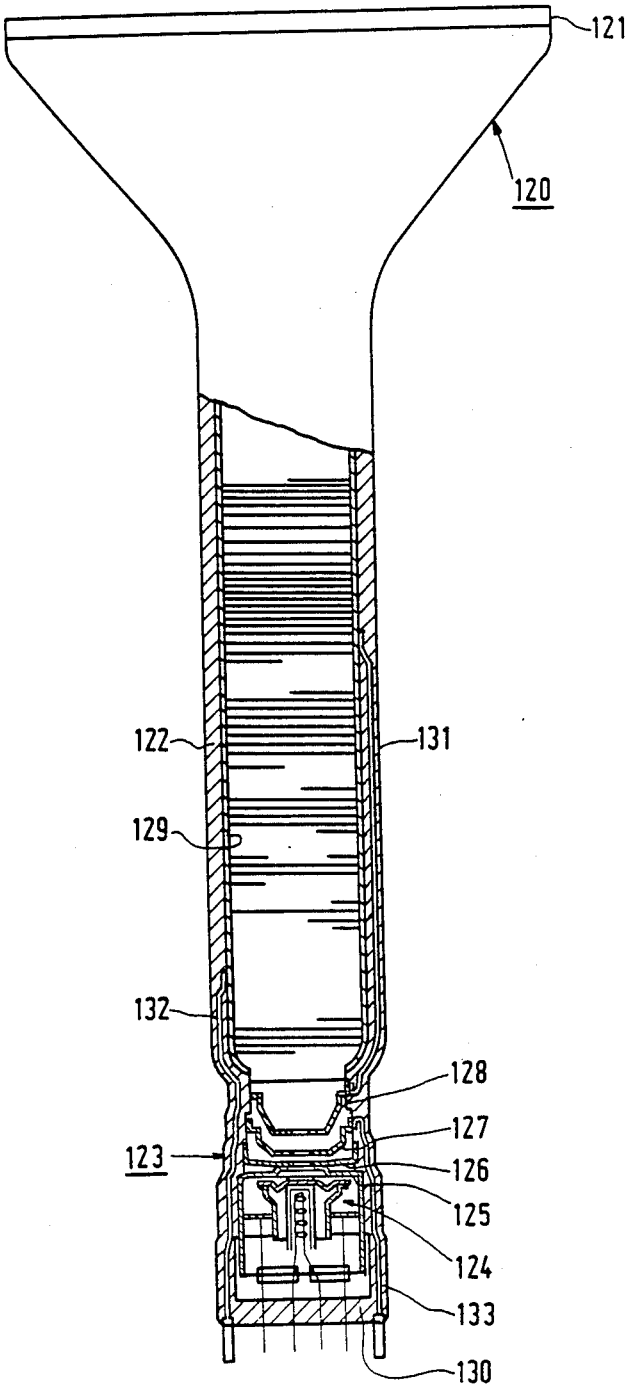
FIG. 3 is a diagrammatic cross-sectional view of a monochrome display tube in which the tubular housing of the electron gun forms a part of the envelope.

Another embodiment of a monochrome display tube according to the invention in which the tubular housing of the electron gun forms a part of the envelope comprises a glass envelope 120 (see FIG. 3) with an optically transparent faceplate 121, and a tubular housing 122 in which an electron gun 123 comprises a cathode 124 and successively arranged apertured grids $g_2$, $g_3$ and $g_4$ formed by drawn, thin-wall metal sleeves 126, 127 and 128. The cathode 124 is carried by, and electrically insulated from a drawn, thin-walled metal sleeve 125 which constitutes a grid $9_1$. The high-ohmic resistance layer is denoted by 129 and 5-segment helical bi-potential focusing lens is provided on the inner wall of the tubular housing 122. The envelope is closed in an airtight manner by means of a closing plate 130. The electrical connections to the high-ohmic resistive layer 129 and the grids $9_3$ and $g_4$ are obtained by means of lead-out wipes 131, 132, 133 extending within the wall of the tubular housing.

Figure 4:
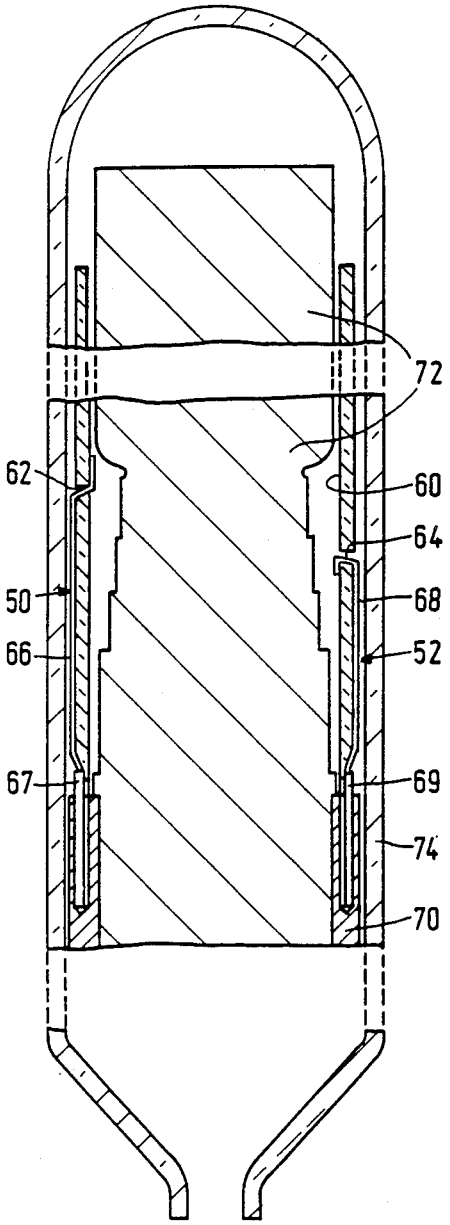
FIG. 4 is a diagrammatic longitudinal cross-sectional view showing the juxtaposition of two electrical contacts and two glass cylindrical members prior to their being united into an inseparable tubular body.

Referring now to FIG. 4 a tubular body 22 with integral lead-out wires 50, 52 is made by taking lead glass cylindrical member 60 and providing through-aperture 62, 64, for example by sandblasting. Lead-out wires 50, 52 each comprising a flat strip conductor, 66, 68, of for example a copper/nickel alloy having a thickness of 50 μm and a width of 1 mm which is joined by spot welding or laser welding to nickel/chromium pin 67, 69, have one end inserted into the respective apertures 62, 64 and their pins inserted into holes in a cylindrical block 70. The free ends of the conductors are bent-over or pressed against the inner surface of the first cylindrical member 60. A profiled bipartite suction mandril 72 is inserted into the first cylindrical member 60 and the cylindrical block 70. The mandril 72 has a series of steps of different cross-sectional area formed thereon. The mandril 72 is a good fit inside the first cylindrical member 60 so that all the fluid between them is removed in the suction phase. Failure to ensure that all the gas has been removed may lead to rounded and less precise abutment surfaces being formed in the completed tubular body 22.

The first cylindrical member 60 is pushed against the upper surface of the cylindrical block 70, which upper surface acts as a reference surface. If the wall thickness of the member 60 is rather thick then its lower outer edge is bevelled so that it can be seated on the cylindrical block 70 with the lead-out wires 50, 52 bent outwards slightly. A second lead glass cylindrical member 74 is slid-over the first cylindrical member, the cylindrical block 70 and the mandril 72. A clearance of the order of 1 mm exists between the members 60 and 74. One end of the member 74 is tapered to provide a connection to a vacuum pump (not shown) and other end is melted and deformed to form a closed end.

In a non-illustrated variant of the second cylindrical member 74 it is closed at one end and the other end is open and is received in a suitably constructed seal of the vacuum pump.

The second cylindrical member 74 containing the mentioned members is coupled to a vacuum pump and placed in an oven. The interior of the second cylindrical member 74 is evacuated to between $10^{-5}$ and $10^{-6}$ mm Hg while it is rapidly heated to about 620° C., say at a mean rate of 50° C./minute. The heating cycle lasts for about 26 minutes during which time the glass of both the members 60 and 74 softens and unites as it is drawn onto the mandril 72, trapping the conductors 66, 68 in the softened glass. The result is the tubular body 22 with the electrical connections lying within thickness of the wall.

Figure 5:
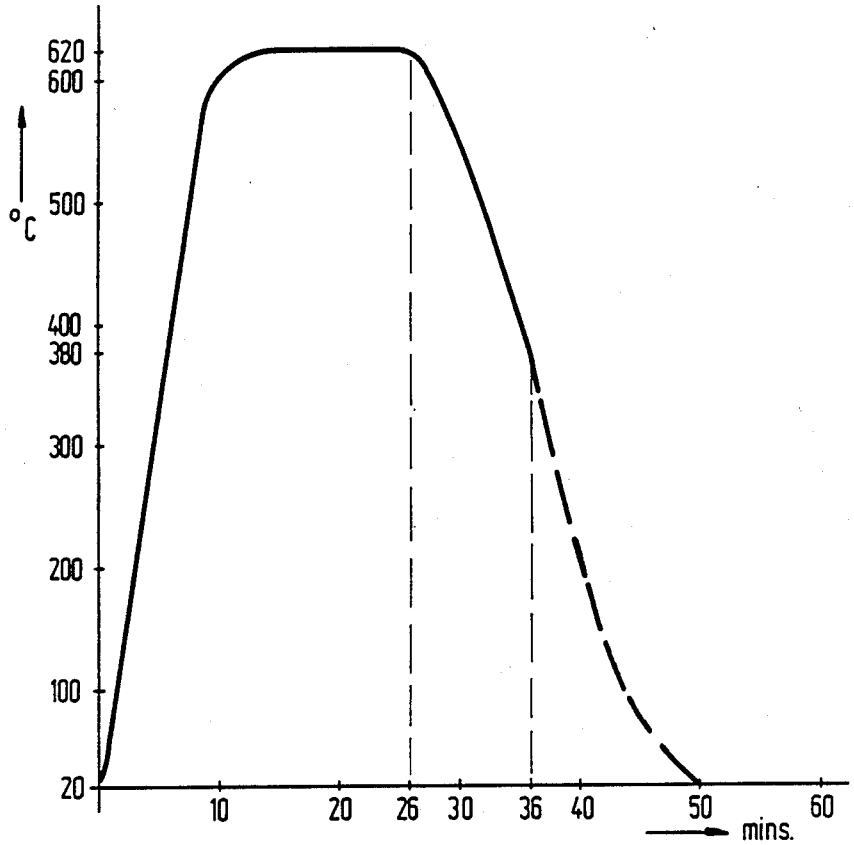
FIG. 5 is a graph of temperature (°C.) versus time (in minutes) of the heating-cooling cycle followed when making the tubular body 22.

Cooling of the tubular body 22 is preferably done very slowly in an annealing oven. However it has been found that this process can be speeded-up without experiencing deleterious stressing and cracking of the body 22 by cooling the body to about 380° C. at a controlled rate over ten minutes and then removing the body from the oven and allowing it to cool down in the ambient atmosphere. During this time the sub-atmospheric pressure is maintained. FIG. 5 illustrates by a full line the critical part of the heating/cooling cycle and the less critical part is broken lines.

Subsequently the tubular body 22 is cut to length permitting the removal of the bipartite mandril 72 and the cylindrical block 70.

The terminal portions of the conductors 66, 68 follow the contour of the wall of the tubular body 22 and are not covered by glass. Consequently a quality check on the electrical connections can be readily effected.

Figure 7:
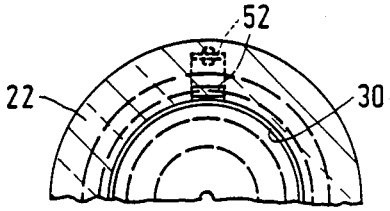
FIG. 7 is a view from the line VI'—VI' in FIG. 5.
Figure 6:
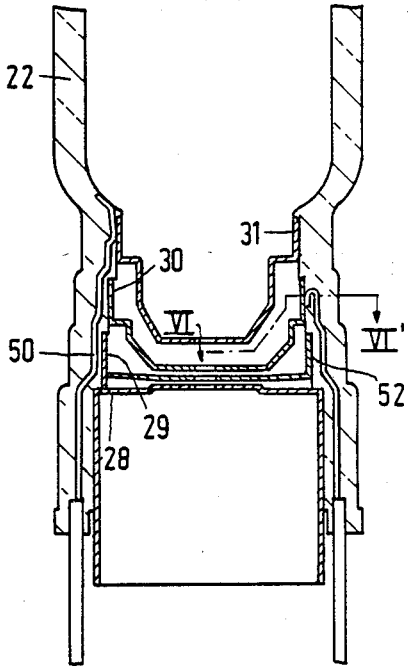
FIG. 6 is a diagrammatic partial longitudinal cross-sectional view showing the electrical connections extending within the thickness of the wall of the tubular body.

FIG. 6 shows the pre-formed cup-shaped electrodes 28, 29, 30 and 31 inserted into and engaging the close tolerance abutment surfaces preformed in the tubular body 22 by the steps on the mandril 72. FIG. 7 which is a section on the line VI—VI' in FIG. 6 shows the substantially tangential contact between the electrode 30 and the lead-out wire 52.

In the event of providing a helical focusing lens this is done prior to the insertion of the cup-shaped electrodes 28 to 31. A suitable technique for providing such a focusing lens is disclosed in European Patent Specification No. 0197584. A brief description of European Patent Specification No. 0197584 will be given for the sake of completeness. Initially a suspension of ruthenium hydroxide precipitated in a mixture of glass particles and water is applied to the interior of the relevant section of the tubular body 22 and allowed to dry. The dried material makes electrical contact with the lead-out wire 50. The tubular body 22 is then rotated about its longitudinal axis and the helical segments are then scored in the dried suspension layer by a chisel which is moved slowly parallel to the axis of the body 11. The tubular body then undergoes a firing treatment during which the dried suspension becomes a glass enamel with ruthenium oxide particles. The enamel has a high electrical resistance and the interruption between the turns of the helices are highly voltage resistant. Thereafter the cup-shaped electrodes can be inserted the tubular body. In the embodiment shown the lips of the cup-shaped electrodes determine the relative positions of these electrodes. Consequently the electrodes have to be made to a high degree of precision.

As a vacuum-tight seal is not required between the lead-out wires and the tubular body then it is not essential to match the coefficients of expansion of the various materials. The more critical aspects are that the electrical connections are of non-magnetic materials otherwise they may be a source of unwanted magnetic fields and that the material of the tubular body can resist physically and electrically breaking-down under the temperature fluctuations which occur in the further processing of the electron gun and of the cathode ray tube in which the electron gun is fitted and in the operation of the completed tube. Additionally any conductors passing close to the lens fields produced by the helices 33 to 37 should have the smallest cross-section permissable, for example circular, so that the field produced by the current in such a conductor has negligible effect on the lens fields.

Figure 8:
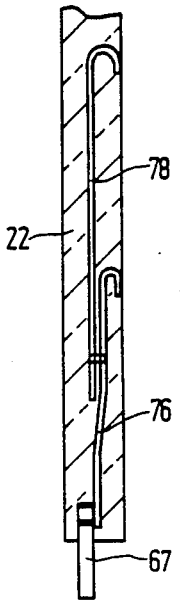
FIG. 8 illustrates one method of making an interconnection with axially spaced points in the tubular body.

FIG. 8 illustrates one method by which two interconnected lead-outs can be provided. The lead-out connection comprises a pin 67 to which a first lead-out wire 76 is attached by spot or laser welding. A second lead-out wire 78, which may be of a different cross-sectional shape to the first wire 76, is attached, for example by spot or laser welding, to the first wire 76 intermediate its point of attachment to the pin 67 and its free end. Such an arrangement enables both wires 76, 78 to have some freedom when being threaded through respective apertures in the first cylindrical member 60 (FIG. 4) Thereafter the sealing of the wires 76, 78 in the wall of the tubular body 22 proceeds as described with reference to FIGS. 4 and 5.

Figure 9A:
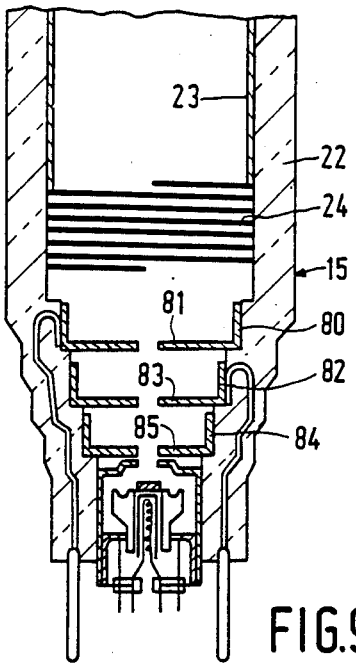
FIGS. 9A and 9B illustrate, respectively, a partial longitudinal sectional view of an electron gun having stepped abutment portions of increasing cross-sectional size progressing from the adjacent end of the tubular body and a one-piece mandril on which these abutment portions are formed.
Figure 9B:
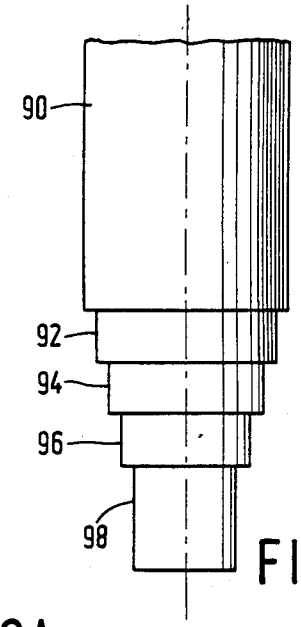

FIG. 9A shows the beam forming part and the pre-focusing lens 24 of another embodiment of an electron gun. This embodiment is made in a manner similar to that described with reference to FIGS. 4 and 5 but, instead of a bipartite mandril, a one part suction mandril 90 (FIG. 9B) is used. Steps 92 to 98 at the end of the mandril 90 are of decreasing cross-sectional area so that when the tubular body 22 has been formed the mandril 90 can be withdrawn through what will be the front end of the eventual electron gun 15. Since the stepped abutments are of decreasing cross-sectional area progressing rearwards then the cup-shaped electrodes 80, 82 and 84 are inserted from the front end beginning with the electrode 84.

Figure 10A:
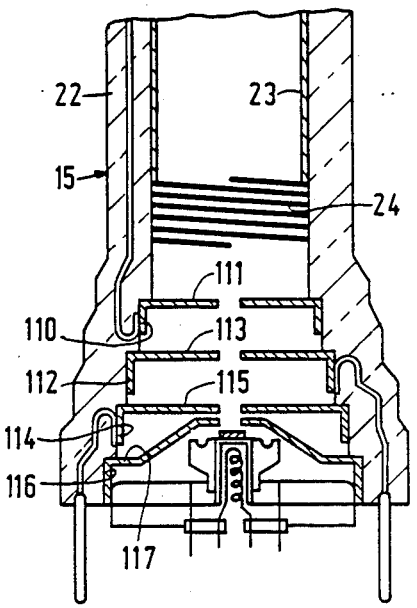
FIGS. 10A and 10B illustrate, respectively, a partial longitudinal sectional view of an electron gun having stepped abutment portions of decreasing cross-section size progressing from the adjacent end of the tubular body and a one-piece mandril on which these abutment portions are formed.
Figure 10B:
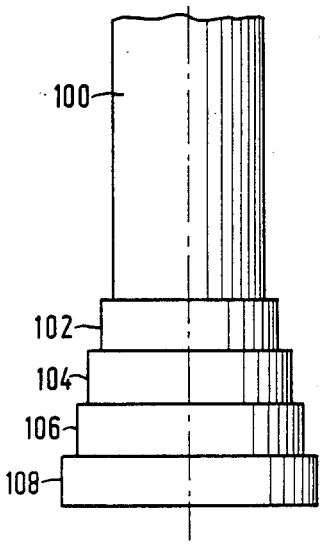

FIG. 10A shows the beam forming part and the pre-focusing lens 24 of a further embodiment of an electron gun. This embodiment is made in a manner similar to that described with reference to FIGS. 4 and 5 but, instead of a bipartite mandril, a one part suction mandril 100 (FIG. 10B) is used. Steps 102, 104, 106 and 108 at the end of the mandril 100 are of increasing cross-section so that when the tubular body 22 has been formed the mandril 100 can be withdrawn through what will be the rear end of the eventual electron gun 15. Since the stepped abutments are of increasing cross-sectional area progressing rearwards then cup-shaped electrodes 110, 112, 114 and 116 are inserted from the rear end beginning with the electrode 110. Since the tubular portion of the body 22 has the smallest cross-sectional area then the focusing lens may exhibit a greater spherical aberration compared to those embodiments in which the tubular portion is of the largest cross-section (FIG. 9A) or can be predetermined independently of the size of the stepped abutments in the beam forming part (FIG. 2).

FIGS. 9A and 10A show the planar parts 81, 83 and 85 and 111, 113, 115 and 117, respectively, of the cup-shaped electrodes bearing against their respective stepped abutment surfaces. Since these surfaces can be replicated with a high degree of precision, of the order of 5 $\mu$m, mounting the cup-shaped electrodes this way around avoids a possible source of error due to variation in the length of the skirted portion of the cup-shaped electrodes. In the embodiment shown in FIG. 2 the cup-shaped electrodes 28 to 31 can also be mounted this way around.

Although in the illustrated and described embodiments the pre-focusing and main focusing lens have been formed by helices, the desired potential distribution can be obtained by varying the resistance of the layer applied to the internal surface of the tubular body for example by varying the thickness or the resistivity of the plain layers and/or helices or by implementing the focusing lens as a plurality of contiguous cylindrical bands of different length, layer thickness and/or resistivity.

What is claimed is:

1. A method of making an electron gun for an electron beam device, the electron gun comprising an electrically insulating tubular body having electrodes provided therein and electrical connections to said electrodes, the method comprising pre-positioning one or more conductors on the external surface of a first cylindrical member, a terminal portion of the or each conductor extending through an aperture or a respective aperture in the wall of the first member, providing a suction mandril interiorly of the first member, arranging a second cylindrical member about the first member, uniting the first and second members with the conductors therebetween by heating them and drawing them under sub-atmosphere pressure onto the suction mandril so that the first and second members unite inseparably to form a tubular body, removing the suction mandril from the formed tubular body and providing electrodes in said tubular body.

2. The method as claimed in claim 1, characterized in that the mandril comprises a profiled bipartite mandril, at least one part of which has at least two steps of different cross-sectional area thereon.

3. A method as claimed in claim 1, characterized in that the mandril comprises a profiled one-part mandril having an end portion with at least two steps of different cross-sectional area thereon.

4. A method as claimed in claim 1, characterized in that the first and second cylindrical members consist of a vitreous material.

5. A method as claimed in claim 4, characterized in that the first and second cylindrical members are heated to a temperature of the order of 620° C., under a sub-atmopsheric pressure of $10^{-5}$ to $10^{-6}$ mm Hg for at least 26 minutes.

6. A method as claimed in claim 5, characterized in that the first and second cylindrical members are heated at a mean rate of 50° C. per minute for the first ten minutes.

7. A method as claimed in claim 4, characterized in that the sub-atmospheric pressure is maintained during cooling of the tubular body.

8. A method as claimed in claim 7, characterized in that the rate of cooling of the tubular body down to at least 380° C. is at a controlled rate.

9. A method as claimed in claim 1, characterized in that at least some of the electrodes are formed in a resistive layer provided in the tubular body.

10. A method as claimed in claim 9, characterized in that at least some of the electrodes are formed as helices in the resistive layer.

11. A method as claimed in claim 9, characterized in that at least some of the electrodes are formed as bands of resistive material of different thickness.

12. A method as claimed in claim 9, characterized in that at least some of the electrodes are formed of bands of material having at least two different resistivities.

13. A method as claimed in claim 1, characterized in that at least some of the electrodes comprise deep drawn metal components which bear against the step-like abutments formed in the tubular body.

14. A method as claimed in claim 13, characterized in that the deep drawn metal components each comprise a planar portion which is arranged to bear against an associated step-like abutment formed in the tubular body.

15. A method as claimed in claim 1, characterized in that at least the conductors connected to the deepdrawn metal components are connected to respective pins, and in prepositioning the conductors, the pins are located in a cylindrical block which serves as a reference surface for the first cylindrical member.

16. A method as claimed in claim 1, characterized in that the lead-out wires are of a non-magnetic material.

17. A method as claimed in claim 1, characterized in that the suction body is rotationally symmetrical.

18. An electron beam device comprising an envelope including a faceplate, a conical portion, and a neck portion said envelope containing an electron gun comprising:

a. a tubular housing consisting essentially of an electrical insulating material, said tubular housing having a longitudinal axis and including an inner surface and an outer surface;

b. a plurality of electrodes disposed along the inner surface of the tubular housing at respective axial positions; and c. at least one conductor embedded in the tubular housing between said inner and outer surfaces and extending generally parallel to at least one of said surfaces over a substantial portion of the conductor's length, a terminal portion of said conductor extending inwardly through said inner surface and making electrical contact with one of the electrodes.

19. A device as in claim 18 where at least one of the electrodes comprises resistive material applied to the inner surface of the tubular housing.

20. A device as in claim 19 wherein the resistive material comprises a helix.

21. A device as in claim 19 or 20 where the conductor is dimensioned to minimize any interfering field produced by current flowing in said conductor.

22. A device as in claim 18 where at least one of the electrodes comprises a drawn metal component having a portion bearing against the inner surface of the tubular housing and said terminal portion of the conductor, and where the conductor has a lead-out portion extending from an end of the tubular housing.

23. A device as in claim 22 wherein the inner surface of the tubular housing defines first and second stepped abutments having different cross-sectional areas, where first and second ones of said drawn metal components are positioned against the first and second abutments, respectively, and including first and second circumferentially-separated ones of the at least one conductor having respective terminal portions thereof extending inwardly through the inner surface of the tubular housing and making electrical contact with respective ones of the deep-drawn component.

24. A device as in claim 23 where the cross-sectional areas of the stepped abutments decrease successively with distance from said end of the tubular housing.

25. A device as in claim 24 where the tubular housing has a cylindrical part axially adjacent a part having the first and second stepped abutments, and where the cross-sectional area of the cylindrical part is larger than the cross-sectional area of at least the smallest one of said abutments.

26. A device as in claim 23 where the cross-sectional areas of the stepped abutments increase successively with distance from said end of the tubular housing.

27. A device as in claim 23 where at least one of the drawn metal components has a planar surface extending transversely to the longitudinal axis and bearing against the respective abutment.

28. A device as in claim 22 where the terminal portion of the at least one conductor comprises a strip conductor.

29. A device as in claim 28 where the lead-out portion of the conductor includes a pin.

30. A device as in claim 18 where the at least one conductor includes first and second terminal portions extending inwardly through the inner surface at first and second axially-spaced locations and making electrical contact with respective ones of the electrodes.

31. A device as in claim 18 where the at least one conductor is non magnetic.

32. A device as in claim 18 where the tubular housing consists essentially of a vitreous material.

33. A device as in claim 18 where the tubular housing forms an integral part of the envelope.

* * * * *